US010639695B2

(12) United States Patent
Shinmiya et al.

(10) Patent No.: US 10,639,695 B2
(45) Date of Patent: May 5, 2020

(54) PRESS FORMING METHOD, METHOD FOR MANUFACTURING PRESS-FORMED COMPONENT AND METHOD FOR DETERMINING PREFORM SHAPE USED IN THESE METHODS

(71) Applicant: JFE STEEL CORPORATION, Tokyo (JP)

(72) Inventors: Toyohisa Shinmiya, Tokyo (JP); Tsuyoshi Shiozaki, Tokyo (JP); Eiji Iizuka, Tokyo (JP); Yuji Yamasaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 119 days.

(21) Appl. No.: 15/114,534

(22) PCT Filed: Jan. 26, 2015

(86) PCT No.: PCT/JP2015/051958
§ 371 (c)(1),
(2) Date: Jul. 27, 2016

(87) PCT Pub. No.: WO2015/115348
PCT Pub. Date: Aug. 6, 2015

(65) Prior Publication Data

US 2016/0354825 A1 Dec. 8, 2016

(30) Foreign Application Priority Data

Jan. 28, 2014 (JP) ..... 2014-012949

(51) Int. Cl.
*B21D 22/00* (2006.01)
*B21D 22/02* (2006.01)
(Continued)

(52) U.S. Cl.
CPC ..... *B21D 22/02* (2013.01); *B21D 22/26* (2013.01); *B21D 53/88* (2013.01)

(58) Field of Classification Search
CPC ..... B21D 22/26; B21D 22/22; B21D 53/88; B21D 22/21
See application file for complete search history.

(56) References Cited

U.S. PATENT DOCUMENTS 5,901,599 A 5/1999 Sato
6,353,768 B1 * 3/2002 Karafillis ..... G06F 17/5018 700/145
(Continued)

FOREIGN PATENT DOCUMENTS

CN 101209470 A 7/2008
CN 103140305 A 6/2013
(Continued)

OTHER PUBLICATIONS

Korean Office Action with partial English language translation for Application No. 2016-7019549, dated Jul. 14, 2017, 11 pages.
(Continued)

*Primary Examiner* — Debra M Sullivan
(74) *Attorney, Agent, or Firm* — RatnerPrestia

(57) ABSTRACT

A method is provided for press forming a product having a shape of a top board portion, a vertical wall portion continuously formed from the top board portion and a flange portion continuously formed from the vertical wall portion at a press process of two or more stages, wherein a convex or concave bead shape is preformed in a position of a flat metal sheet as a raw material corresponding to a neighborhood of a position generating breakage or flange wrinkles when the raw material is formed into a product shape, and thereafter a product shape is press formed from the raw material having the preformed bead shape.

8 Claims, 4 Drawing Sheets

(51) Int. Cl.

| | |
|---|---|
| ***B21D 22/26*** | (2006.01) |
| ***B21D 53/88*** | (2006.01) |

(56) References Cited

U.S. PATENT DOCUMENTS

| | | | |
|---|---|---|---|
| 2009/0255317 | A1 | 10/2009 | Flehmig |
| 2012/0234070 | A1 | 9/2012 | Fedorovich |
| 2013/0006543 | A1 | 1/2013 | Hiwatashi |
| 2013/0020000 | A1 | 1/2013 | Carter |
| 2013/0199258 | A1 | 8/2013 | Naitou et al. |
| 2013/0213109 | A1 | 8/2013 | Ogasawara |
| 2013/0239645 | A1 | 9/2013 | Tanaka |
| 2014/0182349 | A1 | 7/2014 | Yonemura |

FOREIGN PATENT DOCUMENTS

| | | | |
|---|---|---|---|
| CN | 103237611 | A | 8/2013 |
| CN | 103286185 | A | 9/2013 |
| JP | 09029349 | | 2/1997 |
| JP | 2001076022 | A | 3/2001 |
| JP | 2006272413 | | 10/2006 |
| JP | 2011218389 | | 11/2011 |
| JP | 2011235356 | | 11/2011 |
| JP | 2012208884 | A | 10/2012 |
| JP | 2013027912 | A | 2/2013 |
| JP | 2013169578 | | 9/2013 |
| WO | 2011126058 | | 10/2011 |
| WO | 2012070623 | | 5/2012 |
| WO | 2012161050 | | 11/2012 |

OTHER PUBLICATIONS

Japanese Office Action with partial English language translation for Application No. JP 2015-559922, dated May 17, 2017, 4 pages.
Chinese Office Action with partial English language translation for Application No. 201580006217.6, dated Apr. 24, 2017, 8 pages.
Extended European Search Report for European Application No. 15743732.8, dated Feb. 3, 2017, 7 pages.
International Search Report and Written Opinion of the International Searching Authority for International Application No. PCT/JP2015/051958 dated Apr. 28, 2015, 6 pages.

* cited by examiner

Example) Spherical head bulging

Example) Hat drawing

PRESS FORMING METHOD, METHOD FOR MANUFACTURING PRESS-FORMED COMPONENT AND METHOD FOR DETERMINING PREFORM SHAPE USED IN THESE METHODS

CROSS-REFERENCE TO RELATED APPLICATIONS

This is the U.S. National Phase application of PCT International Application No. PCT/JP2015/051958, filed Jan. 26, 2015, and claims priority to Japanese Patent Application No. 2014-012949, filed Jan. 28, 2014, the disclosures of each of these applications being incorporated herein by reference in their entireties for all purposes.

FIELD OF THE INVENTION

This invention relates to a press forming method comprising a pressing process of two or more stages and a method for producing a press-formed component as well as a method for determining a preform shape formed prior to a final step in the press forming.

BACKGROUND OF THE INVENTION

In order to attain weight saving of an automobile and improvement of collision safety, it is promoted to increase a strength of a steel sheet used in automobile components. Most of automobile components are manufactured by press forming as a press-formed part being one of press products. However, they have a problem that poor forming such as breakage, wrinkles and the like is caused in the press forming associated with the increase of the strength in the steel sheet. As a main forming method for the automobile components, there are bulging and drawing. In general, the bulging is performed at a state of constraining a surrounding material, so that it is effective to prevent generation of wrinkles in a flange portion. However, since the stretch of the material largely exerts on breaking limit, the formability is lowered in high-strength materials decreasing the stretch. On the other hand, the drawing is performed while inflowing a material from a flange portion, so that breakage is hardly caused but wrinkles are apt to be caused in a flange portion at a corner portion of a L-shaped component or the like causing an inflowing quantity difference. To this end, when a wrinkle-pressing force in the flange portion is increased for suppressing wrinkles, the inflow of the material is constrained to cause breakage.

As a method of improving formability in the drawing, Patent Document 1 discloses a technique wherein the formability is improved by making a wrinkle-pressing mold have a divided structure and optimizing a wrinkle-pressing force in each divided site. Patent Document 2 discloses a technique wherein a bead of a wrinkle-pressing portion is rendered into a pressure-variable point bead to control inflow distribution and hence improve the formability. Patent Document 3 discloses a method wherein a raw material is first drawn shallowly and then subjected to bending with another mold to a final product shape instead of a common forming technique of a L-shaped component formed by drawing.

PATENT DOCUMENTS

Patent Document 1: JP-A-2011-235356
Patent Document 2: JP-A-H09-029349
Patent Document 3: WO2012-070623

SUMMARY OF THE INVENTION

In the technique disclosed in Patent Document 1, however, since the wrinkle-pressing mold is divided, the structure of the mold becomes complicated and hence the manufacturing cost of the mold is increased. Also, the control of the proper wrinkle-pressing force is difficult because it is different every the component. In the technique disclosed in Patent Document 2, the press pressure of the bead is variable, so that a more complicated mold structure is required to bring about the increase of the mold cost. In the technique disclosed in Patent Document 3, the occurrence of breakage or wrinkles can be avoided, but only a component having a shape of a top board, one side wall extended from the top board and one flange face connected to the side wall is manufactured as a L-shaped bend part joined to another component, so that a L-shaped component having a hat-type sectional form over a full length of the component cannot be manufactured and hence the form of the product is restricted.

Therefore, the invention is to provide a press forming method comprising a press process of two or more stages, which suppresses the occurrence of breakage or wrinkles in the bulging or drawing without involving a mold of a complicated structure, an increase of a press process or a restriction of a component form and improves a yield and a formability effectively, and a method for manufacturing a press-formed component as well as a method for determining a preform shape formed prior to a final step, which used in these methods.

The inventors have examined a method of suppressing breakage in the drawing and bulging or wrinkles of a flange in the drawing and obtained a knowledge that the breakage or wrinkles can be suppressed by preforming a bead shape in a position of a blank corresponding to a neighborhood of a risk site generating breakage or wrinkles of a formed component and then forming the preformed blank to a product shape or a press-formed component shape as a type thereof.

In order to achieve the object based on the above knowledge, the invention includes a method for press forming a product having a shape of a top board portion, a vertical wall portion continuously formed from the top board portion and a flange portion continuously formed from the vertical wall portion at a press process of two or more stages, characterized in that a convex or concave bead shape is preformed in a position of a flat metal sheet as a raw material corresponding to a neighborhood of a position generating breakage or flange wrinkles when the raw material is formed into the product shape, and thereafter the product shape is press formed from the raw material having the preformed bead shape.

And also, the invention achieving the object based on the above knowledge includes a method for manufacturing a press-formed component having a shape of a top board portion, a vertical wall portion continuously formed from the top board portion and a flange portion continuously formed from the vertical wall portion at a press process of two or more stages, characterized in that a convex or concave bead shape is preformed in a position of a flat metal sheet as a raw material corresponding to a neighborhood of a position generating breakage or flange wrinkles when the raw material is formed into the press-formed component shape, and thereafter the press-formed component is press formed from the raw material having the preformed bead shape.

Furthermore, the invention used in the press forming method and the method for manufacturing the press-formed component includes a method for determining a preform shape, characterized by comprising an initial shape analysis step of performing a shape analysis with FEM when a flat metal sheet as a raw material is press formed to a product shape or a press-formed component shape, a step of setting a preforming bead shape and a position of introducing such a bead shape based on a position generating breakage or flange wrinkles when the generation is revealed by the initial shape analysis step, a preform analysis step of performing a shape analysis with FEM when the raw material having a preformed bead shape is press formed to a product shape or a press-formed component shape, a step of changing a preforming bead shape and/or a position of introducing such a bead shape based on a position generating breakage or flange wrinkles when the generation is revealed by the preform analysis step, and a step of determining the bead shape and the position of introducing the bead shape in the preform analysis step to be a preforming bead shape and a position of introducing such a bead shape when no generation of breakage or flange wrinkles is revealed by the preform analysis step.

In the press forming method according to an embodiment of the invention, a product having a shape of a top board portion, a vertical wall portion continuously formed from the top board portion and a flange portion continuously formed from the vertical wall portion is press formed at a press process of two or more stages, wherein a convex or concave bead shape is preformed in a position of a flat metal sheet as a raw material corresponding to a neighborhood of a position generating breakage or flange wrinkles when the raw material is formed into a product shape, and thereafter the product shape is press formed from the raw material having the preformed bead shape.

And also, in the method for manufacturing a press-formed component according to an embodiment of the invention, a press-formed component having a shape of a top board portion, a vertical wall portion continuously formed from the top board portion and a flange portion continuously formed from the vertical wall portion is manufactured at a press process of two or more stages, wherein a convex or concave bead shape is preformed in a position of a flat metal sheet as a raw material corresponding to a neighborhood of a position generating breakage or flange wrinkles when the raw material is formed into a press-formed component shape, and thereafter the press-formed component is press formed from the raw material having the preformed bead shape.

Therefore, when the product shape or the press-formed component shape is press formed from the raw material having the preformed bead shape, the flat sheet material is fed from a neighborhood of a position generating breakage or flange wrinkles when the material is formed into a product shape or a press-formed component shape because the convex or concave bead shape is collapsed at such a position, so that the occurrence of breakage due to the excessive stretch of the raw material can be prevented and also the occurrence of flange wrinkles due to the excessive inflow of the raw material from the flange portion can be prevented. Therefore, the occurrence of breakage or wrinkles in the drawing or bulging can be suppressed without a mold of a complicated structure, an increase of a press process and a restriction of a component shape to improve the yield and formability effectively.

Moreover, in the press forming method and the method for manufacturing the press-formed component according to the invention, the position generating breakage or flange wrinkles may be judged based on results when the shape analysis is performed with FEM (Finite Element Method) in the press forming from the raw material shape to the product shape or the press-formed component shape. This procedure is preferable because it is made redundant to use a mold for examining the position generating breakage or flange wrinkles when the raw material sheet is formed actually.

In the press forming method and the method for manufacturing the press-formed component according to the invention, the preforming of the bead shape may be performed at a blanking step of the raw material, which is preferable because the addition of a specialized step for preforming is not required.

On the other hand, the method for determining the preform shape according to an embodiment of the invention comprises an initial shape analysis step of performing a shape analysis with FEM (Finite Element Method) when a flat metal sheet as a raw material is press formed to a product shape or a press-formed component shape, a step of setting a preforming bead shape and a position of introducing such a bead shape based on a position generating breakage or flange wrinkles when the generation is revealed by the initial shape analysis step, a preform analysis step of performing a shape analysis with FEM when the raw material having a preformed bead shape is press formed to a product shape or a press-formed component shape, a step of changing a preforming bead shape and/or a position of introducing such a bead shape based on a position generating breakage or flange wrinkles when the generation is revealed by the preform analysis step, and a step of determining the bead shape and the position of introducing the bead shape in the preform analysis step to be a preforming bead shape and a position of introducing such a bead shape when no generation of breakage or flange wrinkles is revealed by the preforming analysis step.

Therefore, the procedure of performing the preform analysis by changing the preforming bead shape and/or the position of introducing such a bead shape is repeated until no generation of breakage or flange wrinkles is revealed, so that the bead shape and the position of introducing such a bead shape to be preformed in the actual press forming can be accurately determined to be a bead shape and a position not generating breakage and flange wrinkles when the preformed raw material is press formed to a product shape or a press-formed component shape at a final step.

In the method for determining the preform shape according to the invention, the bead shape can be set so as to extend in a direction parallel to an extending direction of a breakage portion, which is preferable because the material can be fed to the breakage portion over a full length of its extending direction through the bead shape.

Also, in the method for determining the preform shape according to an embodiment of the invention, a maximum principal strain direction of the breakage portion is determined and then the bead shape may be set so as to extend in a direction perpendicular to the maximum principal strain direction, which is preferable because the raw material can be fed in a direction stretching the raw material through the bead shape.

Furthermore, in the method for determining the preform shape according to an embodiment of the invention, a maximum principal strain distribution in the breakage portion is determined at a section in a direction perpendicular to the extending direction of the breakage portion and a rising position of the maximum principal strain may be set as a preforming position, whereby the breakage is not caused in the bead portion without excessively increasing the maximum principal strain.

In the method for determining the preform shape according to an embodiment of the invention, a stretching quantity L0 of the raw material in the breakage portion is determined from a sectional shape of the breakage portion in a direction perpendicular to the extending direction of the breakage portion and the preforming bead shape may be set to have a section wherein a stretching quantity L of the raw material in the bead portion determined from the sectional shape of the preforming bead shape is $0.1\times L0 \leq L \leq 1.0\times L0$, which is preferable because the occurrence of wrinkles due to surplus material in the bead portion or the occurrence of breakage due to the shortage of the material fed in the breakage portion can be prevented.

And also, in the method for determining the preform shape according to the invention, the bead shape extending in a direction parallel to an extending direction of the flange portion can be set to a position of the raw material corresponding to a vertical wall in the vicinity of a position generating flange wrinkles, which is preferable because the inflow of the raw material from the position generating flange wrinkles can be suppressed in the flange portion to prevent the occurrence of flange wrinkles.

Further, in the method for determining the preform shape according to the invention, a difference W−W0 between an inflow quantity W of the material from the position generating flange wrinkles and an inflow quantity W0 of the material from a flange portion generating no flange wrinkles adjacent to the position generating flange wrinkles is determined and the preforming bead shape may be set to have a section wherein a stretching quantity L of the raw material in the bead portion determined from the sectional shape of the preforming bead shape is $0.1\times(W-W0) \leq L \leq (W-W0)$, which is preferable because the occurrence of wrinkles due to surplus material in the bead portion or the generation of flange wrinkles due to surplus material fed from the position generating flange wrinkles can be prevented.

DETAILED DESCRIPTION OF EMBODIMENTS OF THE INVENTION

Figure 1:
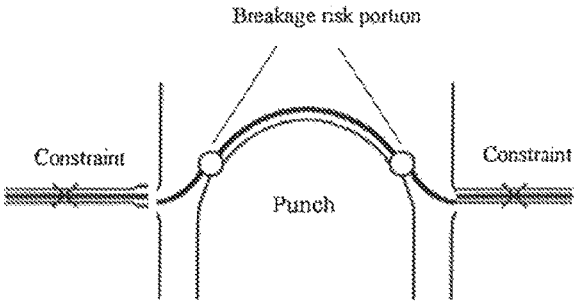
FIG. 1 PRIOR ART
FIG. 1 is a schematic view in a section of a mold showing a usual forming method for two kinds of press forming as a target example of applying a press forming method according to an embodiment of the invention.
Figure 1:
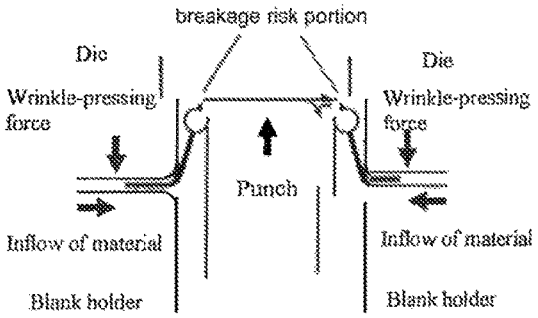
FIG. 1 PRIOR ART

An embodiment of the invention will be described in detail with reference to the accompanying drawings below. As shown in FIG. 1, a breakage in a blank B as a raw steel sheet material being a flat metal sheet at a shoulder portion of a punch in the bulging or drawing is generated by concentration of strain into a site of the raw material located at the shoulder portion of the punch because a site of the raw material located at a top face of the punch is not deformed by frictional resistance between the mold and the raw material (outflow of the material from the position of punch top face is small).

Figure 2:
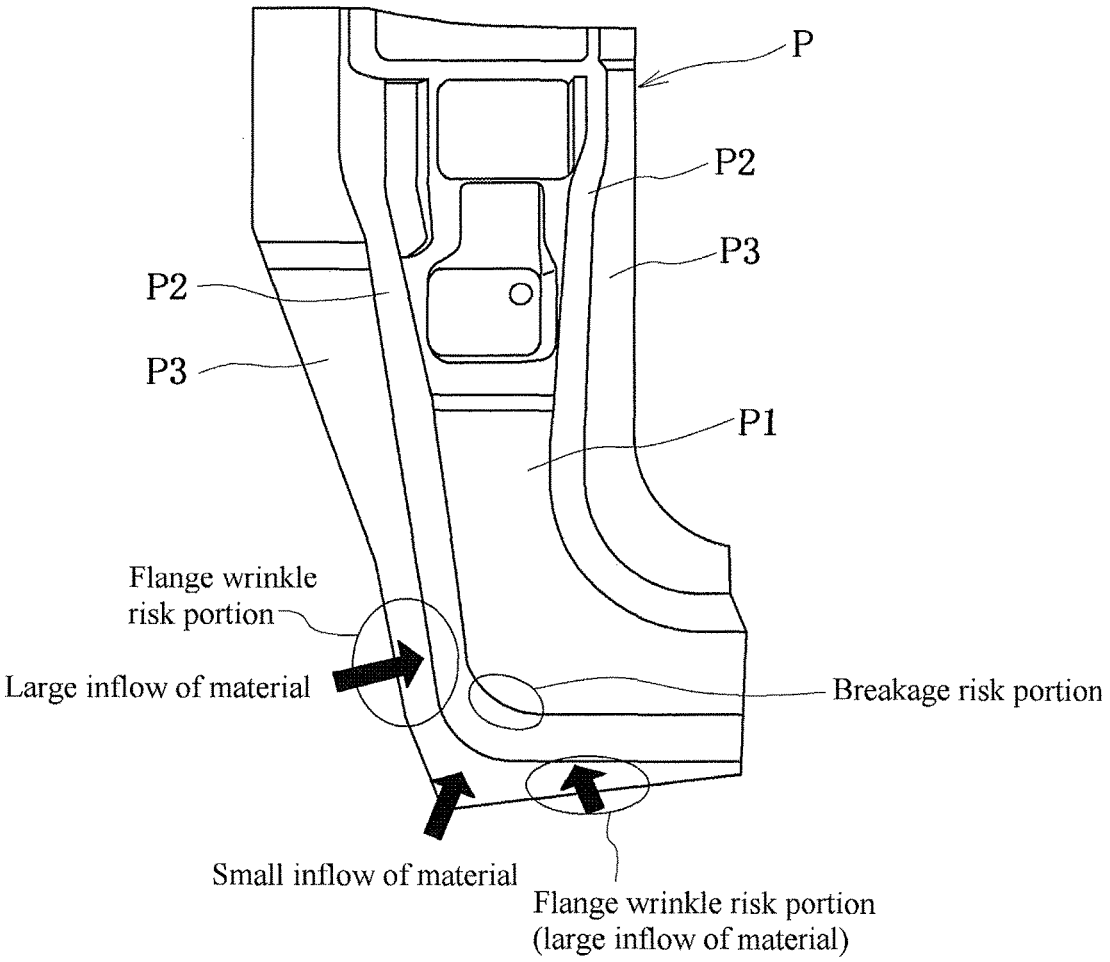
FIG. 2 is a schematic view illustrating an example of a product shape applied by an embodiment of the press forming method according to the invention.

As shown in FIG. 2, when a press-formed component having a hat type sectional shape of a top board portion P1, a vertical wall portion P2 continuously formed in the top board portion P1 and a flange portion P3 continuously formed in the vertical wall portion P2, for example, an L-shaped press-forming component P in a planar view is manufactured by drawing as a press-formed product, an inflow of a material from the flange portion P3 is small in a corner portion, while an inflow of the material from the flange portion P3 is large in a portion adjacent to the corner portion so that flange wrinkles are generated in the portion adjacent to the corner portion resulting from the inflow quantity difference in the flange portion P3.

Therefore, it is possible to avoid any forming failures such as breakage and flange wrinkles by promoting an inflow of a raw material into a special portion.

Figure 3:
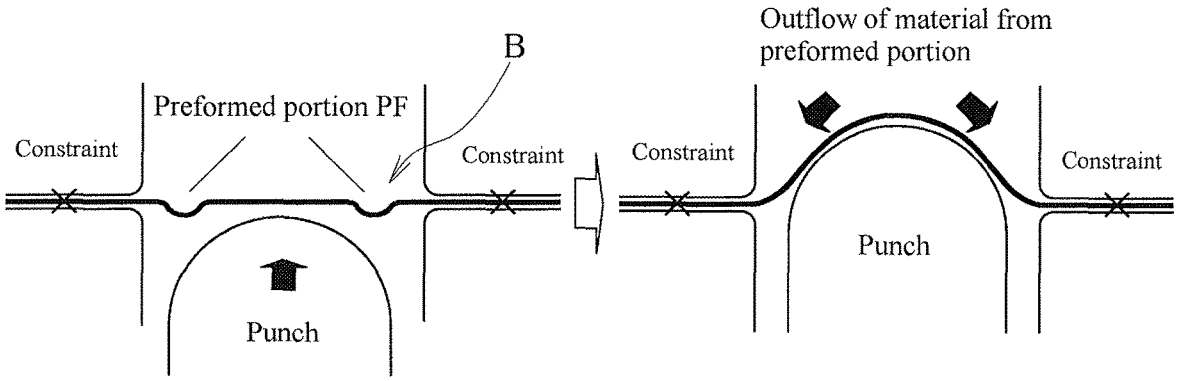
FIG. 3 is a schematic view in a section of a mold showing an embodiment of the press forming method according to the invention applied to the bulging shown in a left side of FIG. 1.

As a state of a raw material before and after final forming is shown in right and left of FIG. 3, a blank B having a preformed concave bead portion (preformed portion) PF is used in a side of a punch lateral to a position of generating breakage in the bulging, whereby the preformed bead portion PF is collapsed on the way of forming to a product shape to produce outflow of material from the bead portion PF of the raw material to a stress concentrating portion located at a shoulder portion of the punch, and hence strain can be dispersed to improve the formability.

Figure 4:
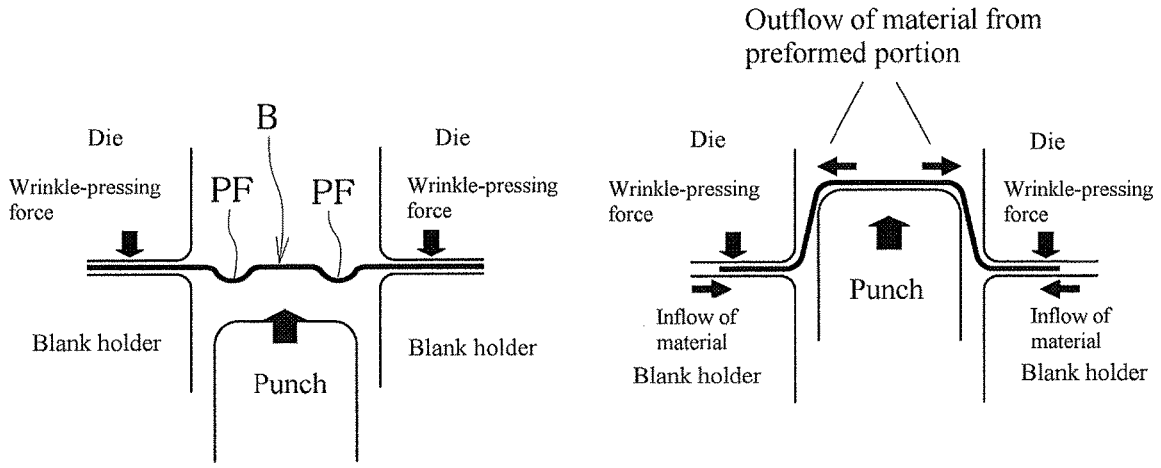
FIG. 4 is a schematic view in a section of a mold showing an embodiment of the press forming method according to the invention applied to the drawing shown in a right side of FIG. 1.

Also, as a state of a raw material before and after final forming is shown in right and left of FIG. 4, the preforming of the bead portion PF is introduced to breakage of the raw material generated in the drawing and located at the shoulder portion of the punch in the same manner as mentioned above, whereby the formability is improved. In the drawing, the preforming of the bead portion PF is introduced into the vertical wall portion in addition to the top board portion located in a top of the punch to mitigate tension from the side of the flange portion, which is effective to improve the formability.

As to flange wrinkles generated in the vicinity of the corner portion or the like during the drawing, the preforming of the bead portion PF is introduced into the top board portion located at a top of the punch, which portions being large in the inflow of material into the vertical wall portion, and vertical wall portion, whereby the inflow quantity from the flange portion is decreased due to the outflow of material from the bead portion in the top board portion and the vertical wall portion to mitigate the flange wrinkles.

Figure 5:
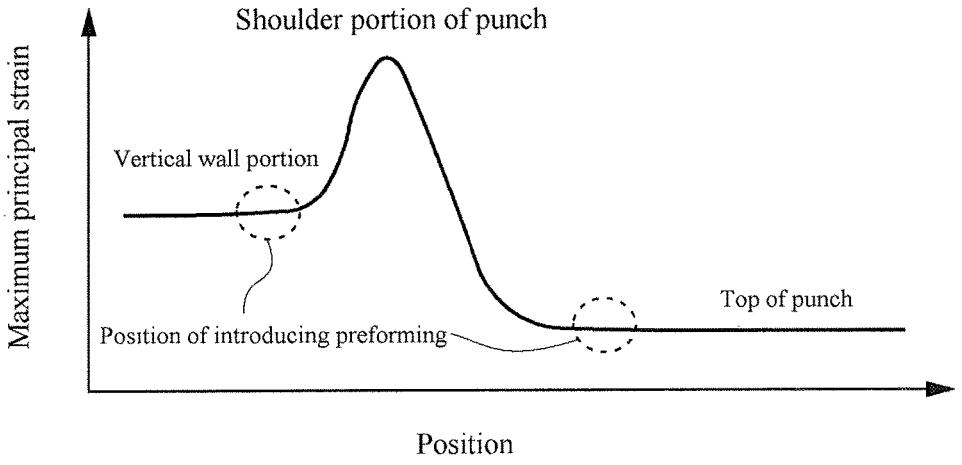
FIG. 5 is a diagram showing a relation between a position (site) of a raw material and a magnitude of maximum principal strain in the drawing shown in a right side of FIG. 1.

In FIG. 5 is shown a maximum principal strain distribution of the raw material in a cross-sectional direction during the drawing shown in FIG. 4. A position of introducing the preformed portion (bead portion PF) is appropriate to be a rising (increasing) portion of the maximum principal strain. If the preformed portion is introduced into a large zone of the maximum principal strain (breakage risking portion), strain generated in the preforming is added to strain generated in the final forming, and hence breakage is apt to be easily generated in the preformed portion.

Since the vertical wall portion is large in strain quantity, if the preformed portion is introduced thereinto, the possibility of generating breakage cannot be denied. Therefore, it is preferable to introduce the preformed portion into the top board portion having strain quantity smaller than that of the vertical wall portion and located at the top of the punch. Also, as the preformed portion is exceedingly remote from the rising portion of the maximum principal strain, the effect of outflowing material from the preformed portion to the breakage risking portion becomes small. Furthermore, a direction of introducing the preforming of the bead shape (extending direction of bead shape) is a direction parallel to an extending direction of breakage portion simply. If the maximum principal strain direction of the breakage portion can be specified by shape analysis through a program of FEM (Finite Element Method), use of a scribed circle or the like, a higher effect can be expected by introduction of the preforming of the bead shape extending in a direction perpendicular to the maximum principal strain direction.

A bulging quantity (stretching quantity) L in the preforming is set to be not more than a stretching quantity L0 calculated from a maximum principal strain of a breakage portion located at a shoulder portion of a punch shown in FIG. 5. L0 is determined by subtracting a line length of a flat raw material before preforming from a line length of a bulged portion. L is defined by $0.1\times L0 \leq L \leq 1.0\times L0$. In the case of $L>1.0\times L0$, the line length becomes excessive to generate wrinkles. In the case of $L<0.1\times L0$, the supply of the material from the preformed portion is insufficient, so that breakage cannot be suppressed. In order to obtain sufficient effect of suppressing breakage, it is preferable to be $0.3\times L0 \leq L \leq 1.0\times L0$.

As previously mentioned, the flange wrinkles are apt to be easily generated in a portion producing a difference in the inflow quantity of material from the flange portion to the vertical wall portion such as a neighborhood of a corner portion in the drawing of a L-shaped component. Although it is possible to suppress wrinkles by increasing a wrinkle-pressing force, as the strength of the material becomes higher, it is necessary to more increase the wrinkle-pressing force. As the wrinkle-pressing force is increased, inflow of the material is decreased, and hence breakage is generated in the shoulder portion of the punch or the like.

Figure 6:
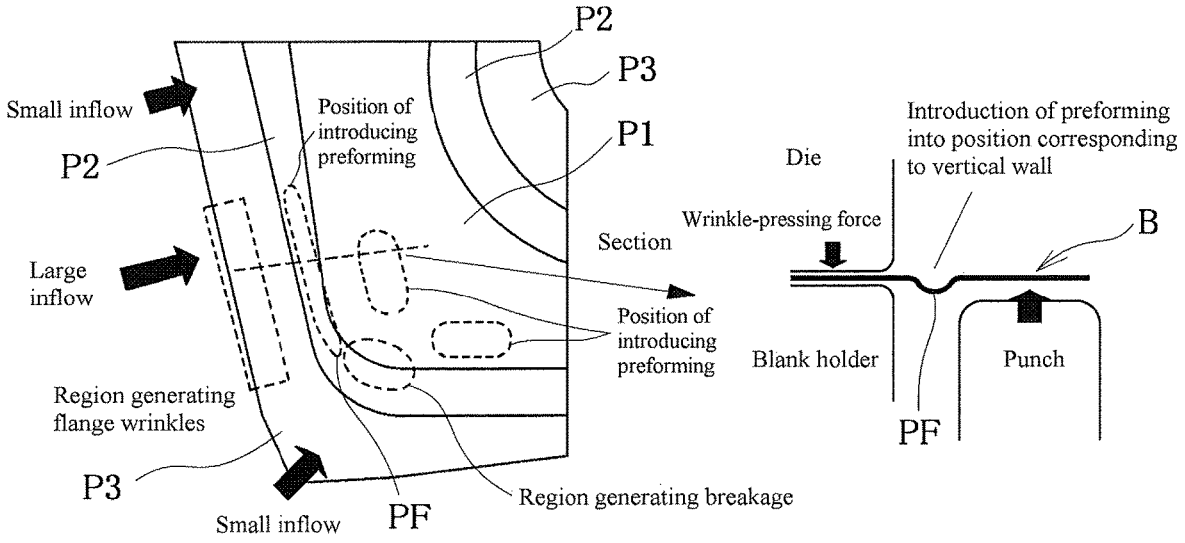
FIG. 6 is a schematic view illustrating an example of a position of introducing a preforming bead portion into a product shape shown in FIG. 2.

In order to suppress the flange wrinkles, it is enough to make inflow difference of material small, or to reduce inflow of material in a portion having a large inflow of material. As shown in FIG. 6, when the preforming of a bead shape PF extending in a direction parallel to an extending direction (up and down directions in the figure) of a flange portion P3 is introduced into a position of a vertical wall portion P2 adjacent to a region generating flange wrinkles in the flange portion P3 of a press-formed component P as a press product shown in FIG. 2, outflow of material is promoted in the vertical wall portion P2 by flattening of the bead shape PF in the final forming to thereby cause an effect of suppressing flange wrinkles in the flange portion P3.

When an inflow quantity of material at a position generating flange wrinkles is W and an inflow quantity of material at a position generating no flange wrinkle in its vicinity is W0, an inflow quantity difference is W−W0. Therefore, it is enough to extend the line length by not more than W−W0 in the preformed portion, wherein a stretching quantity L of the preformed portion is set to be $0.1\times(W-W0) \leq L \leq (W-W0)$. In the case of $L>(W-W0)$, excessive outflow of material from the preformed portion is generated to cause flange wrinkles. In the case of $L<0.1\times(W-W0)$, the outflow effect of material from the preformed portion is small and the generation of flange wrinkles cannot be suppressed sufficiently. In order to suppress flange wrinkles sufficiently, it is preferable to be $0.3\times(W-W0) \leq L \leq (W-W0)$.

The cross-sectional shape of the preformed portion is preferable to be a curved shape in view of the easy collapsing of the preformed portion, but may be a rectangular section or the like as long as the predetermined line length can be ensured. From a viewpoint of decreasing the number of steps, it is also preferable to perform the preforming of the bead shape by bulging at a time of punching in a blanking step of punching out a raw material of a given contour profile from a rectangular or band-shaped raw material sheet before the raw material is formed to a product shape.

Further, the shape and introduction position of the preformed portion may be determined by observing breakage or wrinkles of a product actually press formed from a flat type blank. In the method for determining the preform shape according to an embodiment of the invention, however, the determination can be performed more effectively by using a shape analysis through a usual program of FEM (Finite Element Method) carried by a computer when the blank is press formed to a product shape as shown in a flow chart of FIG. 7.

Figure 7:
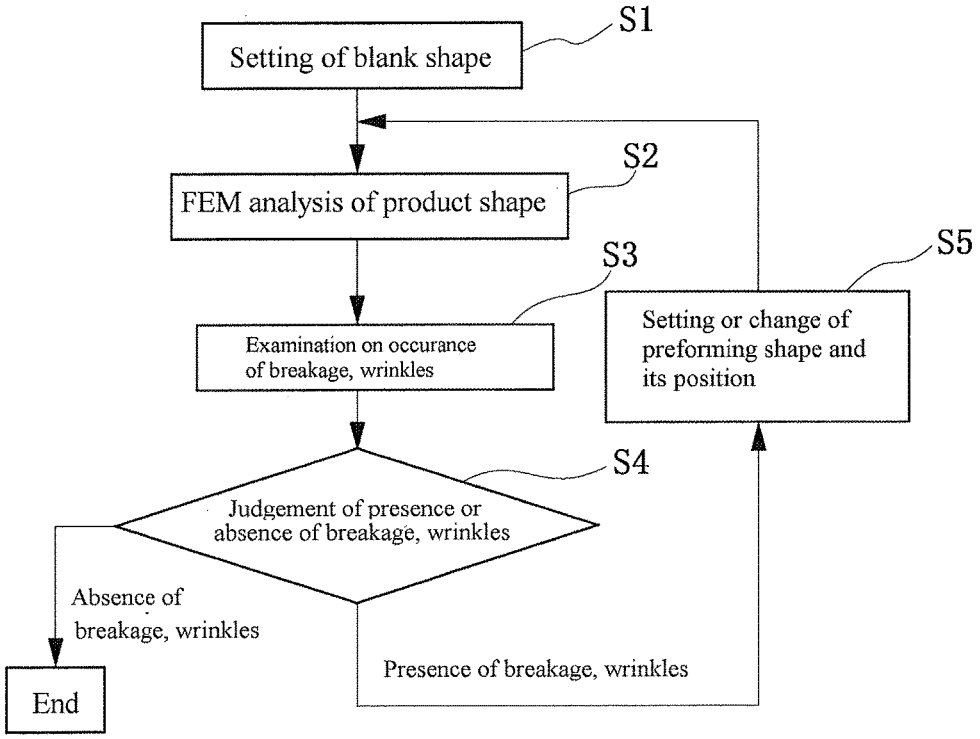
FIG. 7 is a flow chart showing a procedure in an embodiment of the method for determining a preform shape according to the invention.

In the flow chart of FIG. 7, a proper blank shape is first set at a step S1, and then shape analysis with FEM is performed in the press forming from the blank shape to a product shape (press-formed component shape) at a step S2, and subsequently the presence or absence of breakage or wrinkles in the product shape is examined from the analytical results at a step S3, and the presence or absence of generating breakage or wrinkles is judged from the examined results at the next step S4, and a shape, height, length and the like of a preforming bead shape and a position thereof are set at a step S5 if the breakage or wrinkles are generated or are changed if they are already set, and thereafter the shape analysis with FEM at step S2 is again performed on the blank shape having the bead shape in the press forming to a product shape. On the other hand, the above procedure is ended when the generation of breakage or wrinkles are not revealed by judging the generation of breakage or wrinkles from the examination results at the step S4.

According to the method of this embodiment, the preform analysis is repeated by changing a preforming bead shape and/or a position of introducing such a bead shape until no generation of breakage or flange wrinkles is revealed, so that a preforming bead shape and a position of introducing such a bead shape in the actual press forming can be accurately determined to a bead shape and a position of generating no breakage or flange wrinkles in the press forming from the preformed raw material shape to a product shape at a final step.

EXAMPLE

An example of the above embodiment and a comparative example will be described below. Assuming that a L-shaped component shape of a press-formed component P shown in FIG. 2 is used as a product shape, an FEM analysis is conducted in the drawing performed with a press mold comprised of an upper die and a lower mold provided with a punch cooperated with the upper die and a blank holder clipping a blank together with the upper die as shown in FIG. 4. As conditions of FEM analysis, a solver is a LD-DYNA version 971 (dynamic explicit method) and a mesh size is 2 mm. A blank material is a steel sheet of 1180 MPa grade with a thickness of 1.6 mm, and a stress-strain relation approximated by Swift equation of stress-strain curve measured from JIS No. 5 specimen for tensile test. A frictional coefficient between the blank and the mold is 0.12. A cushion force (wrinkle-pressing force) is 50 tons and 80 tons. The judgement of breakage risking portion and flange wrinkle risking portion shown in FIG. 2 is performed by adopting a forming limit diagram (FLD) of a material used in the analysis results.

The results of the above judgement are shown in Table 1.

TABLE 1

| No. | Cushion force (ton) | Preform | Position of introducing preform | L/L0 | L/W-W0 | Presence or absence of breakage | Presence or absence of wrinkles | Remarks |
|---|---|---|---|---|---|---|---|---|
| 1 | 50 | Absence | — | — | — | Presence | Presence (flange) | Comparative Example 1 |
| 2 | 50 | Presence | Top of punch | 1.0 | — | Absence | Absence | Example 1 |
| 3 | 80 | Presence | Top of punch | 0.8 | — | Absence | Absence | Example 2 |
| 4 | 80 | Presence | Top of punch | 0.12 | — | Absence | Absence | Example 3 |
| 5 | 80 | Presence | Top of punch | 0.09 | — | Presence | Absence | Comparative Example 2 |
| 6 | 50 | Presence | Top of punch | 1.10 | — | Absence | Presence (top of punch) | Comparative Example 3 |
| 7 | 50 | Presence | Top of punch and vertical wall | 1.0 | 1.0 | Absence | Absence | Example 4 |
| 8 | 50 | Presence | Top of punch and vertical wall | 1.0 | 0.8 | Absence | Absence | Example 5 |
| 9 | 50 | Presence | Top of punch and vertical wall | 1.0 | 0.12 | Absence | Absence | Example 6 |
| 10 | 50 | Presence | Top of punch and vertical wall | 1.0 | 0.09 | Absence | Presence (flange) | Comparative Example 4 |
| 11 | 50 | Presence | Top of punch and vertical wall | 1.0 | 1.1 | Absence | Presence (flange) | Comparative Example 5 |
| 12 | 30 | Presence | Vertical wall | — | 0.5 | Absence | Absence | Example 7 |
| 13 | 30 | Presence | Vertical wall | — | 0.9 | Absence | Absence | Example 8 |
| 14 | 80 | Absence | — | — | — | Presence | Absence | Comparative Example 6 |
| 15 | 30 | Presence | Vertical wall | — | 0.09 | Absence | Presence (flange) | Comparative Example 7 |
| 16 | 30 | Presence | Vertical wall | — | 1.1 | Absence | Presence (flange) | Comparative Example 8 |

No. 1 (Comparative Example 1) shows results of usual drawing having no preform, in which breakage is generated in a position corresponding to a shoulder portion of a punch and wrinkles are generated in a flange portion. In No. 2-No. 4 (Examples 1-3), a preform is introduced into a position corresponding to a top of a punch as a countermeasure to breakage, and a cushion force of 80 tons is used as a countermeasure to flange wrinkles, but breakage is not observed at a position corresponding to a shoulder portion of the punch. In No. 5 (Comparative Example 2), a line length of the preform is lacking, so that breakage is generated at a position corresponding to the shoulder portion of the punch. In No. 6 (Comparative Example 3), the line length of the preform is sufficient against breakage in a position corresponding to the shoulder portion of the punch, but is too long and hence a surplus of the line length is produced in the top board portion corresponding to the bottom of the punch to generate wrinkles. In No. 7-No. 9 (Examples 4-6), a proper preform is introduced into the top board portion corresponding to the top of the punch and the vertical wall portion, so that not only the breakage at a position corresponding to the shoulder portion of the punch but also the flange wrinkles are not observed.

In No. 10 and No. 11 (Comparative Examples 4 and 5), the line length of the preform introduced into the vertical wall portion is lacking, so that the flange wrinkles are generated in the flange portion. In No. 12 and No. 13 (Examples 7 and 8), the breakage at a position corresponding to the shoulder portion of the punch is suppressed by decreasing the cushion force to 30 tons, while the flange wrinkles are not observed by introducing the preform into the vertical wall portion. When the cushion force is increased for suppressing the flange wrinkle as shown in No. 14 (Comparative Example 6), the breakage is generated at a position corresponding to the shoulder portion of the punch. When the line length of the preform shape is too short as shown in No. 15 (Comparative Example 7), the outflow of material from the flange portion becomes larger and hence the flange wrinkles are generated. On the other hand, when the line length of the preform shape is too long as shown in No. 16 (Comparative Example 8), the outflow of material from the flange portion becomes too small to cause the surplus of the material and hence the flange wrinkles are generated.

Although the above is described based on the illustrated examples, the invention is not limited to such examples and may be properly modified within a scope of the claims, if necessary. For example, the product shape and press-formed component shape may be formed by spherical head bulging with a top board portion of a curved form, or may be other shape such as U shape, channel shape or the like in addition to L shape in a planar view.

The press mold is comprised of an upper die and a lower mold provided with a punch cooperated with the upper die and a blank holder clipping a blank together with the upper die in the above examples, but is not limited thereto. The upper die may be provided with a die positively collapsing a bead portion of a blank between the lower punch, or the mold may be upside-down structure of the above mold.

According to the press forming method and the method for manufacturing a press-formed component according to the invention, the generation of breakage or wrinkles can be suppressed in the drawing or bulging to improve the yield and the formability effectively without involving a mold of a complicated structure, an increase of a press process or a restriction of a component shape.

Also, according to the method for determining a preform shape according to an embodiment of the invention, the procedure of performing the preform analysis by changing the preforming bead shape and/or the position of introducing such a bead shape is repeated until no generation of breakage or flange wrinkles is revealed, so that the bead shape and the position of introducing such a bead shape to be preformed in the actual press forming can be accurately determined to a bead shape and a position not generating breakage and flange wrinkles when the preformed raw material is press formed to a product shape or a press-formed component shape at a final step.

DESCRIPTION OF REFERENCE SYMBOLS

B blank
P pressed product (press-formed component)
P1 top board portion
P2 vertical wall portion
P3 flange portion
PF preformed portion (bead portion)

The invention claimed is:

1. A method for press forming a product having a shape of a top board portion, a vertical wall portion continuously formed from the top board portion and a flange portion continuously formed from the vertical wall portion in a press process of two or more stages, the method comprising:

preforming a convex or concave bead shape at a position of a flat metal sheet as a raw material corresponding to at least one of the top board portion and the vertical wall portion of the product shape when the flat metal sheet is formed into the product shape, and thereafter, press forming the product shape from the metal sheet having the preformed bead shape, while feeding the material of the metal sheet from the preformed bead shape outwardly relative to a center of the metal sheet during the press forming.

2. The method according to claim 1, further comprising, prior to the preforming, performing a shape analysis with FEM in simulated press forming of the flat metal sheet to the product shape carried out by a computer, and judging a position at which breakage is generated based on results of the shape analysis with FEM.

3. The method according to claim 1, further comprising a blanking step of the raw material, the blanking step including the preforming of the bead shape.

4. The method according to claim 1, further comprising:

an initial shape analysis step of performing a first shape analysis with FEM when the metal sheet is press formed to the product shape, a step of setting the bead shape and setting a position of introducing the bead shape based on a position at which breakage is generated if breakage is revealed by the initial shape analysis step, a preform analysis step of performing a second shape analysis with FEM when the metal sheet having the bead shape is press formed to the product shape, a step of changing the bead shape and/or changing the position of introducing the bead shape if breakage is revealed by the preform analysis step, and a step of determining the bead shape to be the convex or concave bead shape and determining the position of introducing the bead shape to be the position of the flat metal sheet corresponding to the at least one of the top board portion and the vertical wall portion of the product shape when no breakage is revealed by the preform analysis step.

5. The method according to claim 4, wherein:

the step of setting the bead shape comprises setting the bead shape so as to extend in a direction parallel to an extending direction of the breakage.

6. The method according to claim 4, wherein the method further comprises a step of determining a maximum principal strain direction of the position at which breakage is generated and then setting the bead shape so as to extend in a direction perpendicular to the maximum principal strain direction.

7. The method according to claim 4, wherein the method further comprises a step of determining a maximum principal strain distribution in the position at which breakage is generated in a direction perpendicular to an extending direction of the breakage; and setting a rising position of the strain as the position of introducing the bead shape.

8. The method according to claim 4, wherein the method further comprises a step of determining a stretching quantity L0 of the raw material in the position at which breakage is generated in a direction perpendicular to an extending direction of the breakage; and setting the preforming bead shape to have a section such that a stretching quantity L of the raw material in a portion of the bead shape is $0.1 \times L0 \leq L \leq 1.0 \times L0$.

* * * * *